US009420657B2

(12) United States Patent
Hua et al.

(10) Patent No.: US 9,420,657 B2
(45) Date of Patent: Aug. 16, 2016

(54) FLAT PANEL ELECTRONIC DEVICE AND CURRENT CONTROL SYSTEM THEREOF

(71) Applicant: NVIDIA Corporation, Santa Clara, CA (US)

(72) Inventors: Jun Hua, Shenzhen (CN); Shuang Xu, Shenzhen (CN)

(73) Assignee: NVIDIA CORPORATION, Santa Clara, CA (US)

( * ) Notice: Subject to any disclaimer, the term of this patent is extended or adjusted under 35 U.S.C. 154(b) by 95 days.

(21) Appl. No.: 13/776,551

(22) Filed: Feb. 25, 2013

(65) Prior Publication Data

US 2014/0125251 A1 May 8, 2014

(51) Int. Cl.

| | |
|---|---|
| ***H05B 37/02*** | (2006.01) |
| ***H05B 33/08*** | (2006.01) |
| ***G09G 3/34*** | (2006.01) |

(52) U.S. Cl.

CPC ..... *H05B 33/0851* (2013.01); *G09G 3/3406* (2013.01); *G09G 2320/0626* (2013.01); *G09G 2330/025* (2013.01); *G09G 2330/04* (2013.01)

(58) Field of Classification Search

CPC .... H05B 37/02; H05B 33/08; H05B 33/0851; H05B 39/04; H05B 41/36; G09G 3/19; G09G 3/3406; G09G 5/00

USPC ..... 315/149, 185 R, 291, 307, 308, 312; 345/102, 204, 212, 214

See application file for complete search history.

(56) References Cited

U.S. PATENT DOCUMENTS

| | | | | |
|---|---|---|---|---|
| 7,511,436 | B2 * | 3/2009 | Xu | 315/307 |
| 2005/0032496 | A1 * | 2/2005 | Saeki | 455/234.1 |
| 2008/0136355 | A1 * | 6/2008 | Han et al. | 315/307 |
| 2009/0122003 | A1 * | 5/2009 | Chen et al. | 345/102 |
| 2010/0013849 | A1 * | 1/2010 | Yun et al. | 345/589 |

FOREIGN PATENT DOCUMENTS

| | | |
|---|---|---|
| TW | 200522796 | 7/2005 |
| TW | 200737072 | 10/2007 |
| TW | 201027319 | 7/2010 |

* cited by examiner

*Primary Examiner* — Thai Pham

(57) ABSTRACT

Embodiments of the present invention provide a flat panel electronic device and a current control system thereof. The current control system comprises: a detecting module for detecting a current in a main circuit of the flat panel electronic device; and a control mechanism for reducing a brightness level of a backlight unit of the flat panel electronic device when the current in the main circuit is larger than or equal to a threshold so that the current in the main circuit is reduced to be less than the threshold. The current control system provided by the present invention reduces the current in the main circuit by reducing the brightness level of the backlight unit. Therefore, it is able to reduce the processing time by more than 10 ms compared with the prior art, and the fast and effective response is an important factor for extending the life of the battery.

20 Claims, 1 Drawing Sheet

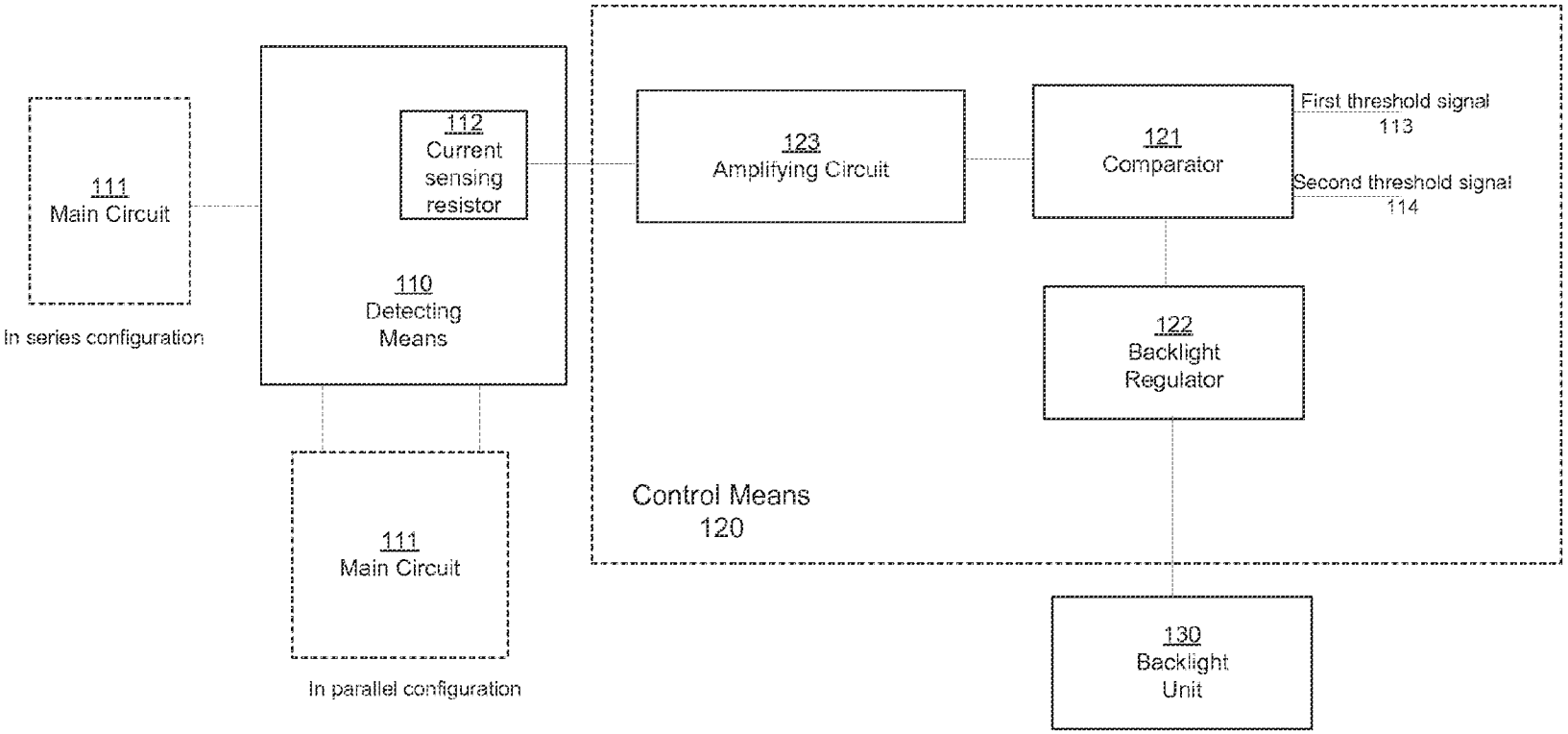
First threshold signal
113
Second threshold signal
114
121
Comparator
122
Backlight
Regulator
130
Backlight
Unit
123
Amplifying Circuit
Control Means
120
112
Current
sensing
resistor
110
Detecting
Means
111
Main Circuit
In parallel configuration
111
Main Circuit
In series configuration

FLAT PANEL ELECTRONIC DEVICE AND CURRENT CONTROL SYSTEM THEREOF

CROSS-REFERENCE TO RELATED APPLICATIONS

This application claims priority to Chinese Patent Application No. 201210441779.1, filed on Nov. 7, 2012, which is hereby incorporated by reference in its entirety.

FIELD OF INVENTION

The present invention relates generally to the field of electronics and, in particular, to a flat panel electronic device and a current control system thereof.

BACKGROUND

The life of the battery of a flat panel electronic device (including a tablet, a flat panel mobile phone, etc.) is one of the most critical problems encountered by the users. The key factor affecting the life of the battery lies in whether the peak current in the main circuit in use exceeds the maximum allowable discharge current or not. The peak current in the main circuit exceeding the maximum allowable discharge current can have a serious effect on the life of the battery. It can also lead to the permanent damage of the battery.

The power capping mechanism of flat panel electronic devices in the prior art usually reduces the peak current by reducing the frequencies of the processor and the communication chip. But reducing the frequencies of the processor and the communication chip will cause the processing speed to reduce and the response time to extend, which is unacceptable to users. Further, reducing the frequencies of the processor and the communication chip requires a complicated calculation process, which needs a processing time from about tens of milliseconds to about hundreds of milliseconds. During this processing time, the battery can be damaged irreversibly.

Therefore, there is a need for providing a flat panel electronic device and a current control system thereof to solve the above discussed problem in the prior art.

SUMMARY OF THE INVENTION

In order to solve the above problem, a current control system of a flat panel electronic device is provided according to one aspect of the present invention, which comprises: a detecting module for detecting a current in a main circuit of the flat panel electronic device; and a control mechanism for reducing a brightness level of a backlight unit of the flat panel electronic device when the current in the main circuit is larger than or equal to a threshold so that the current in the main circuit is reduced to be less than the threshold.

Preferably, the control mechanism comprises a comparator for comparing a detection signal of the current in the main circuit with a threshold signal; and a backlight regulator for regulating the brightness level of the backlight unit according to a comparison result.

Preferably, the control mechanism further comprises an amplifying circuit, the detection signal is the signal amplified by the amplifying circuit.

Preferably, the threshold comprises a first threshold and a second threshold, the first threshold is smaller than the second threshold, the control mechanism controls the backlight unit to reduce to a first brightness level when the current in the main circuit is larger than or equal to the first threshold and less than the second threshold, and the control mechanism controls the backlight unit to reduce to a second brightness level when the current in the main circuit is larger than or equal to the second threshold, wherein the second brightness level is lower than the first brightness level.

Preferably, the control mechanism regulates the brightness level of the backlight unit to a standard brightness level when the current in the main circuit detected by the detecting module is less than the threshold in a predetermined time interval.

Preferably, the predetermined time interval is 5~10 s.

Preferably, the detecting module is connected to the main circuit of the flat panel electronic device in parallel, and the detecting module obtains the current in the main circuit by detecting a branch current.

Preferably, the detecting module is a current sensing resistor.

Preferably, the control mechanism reduces the brightness level of the backlight unit by reducing the current of the backlight unit.

In another embodiment, a flat panel electronic device, having a current control system, is disclosed. The current control system comprises a detecting module for detecting a current in a main circuit of the flat panel electronic device. It also comprises a control device for reducing a brightness level of a backlight unit of the flat panel electronic device when the current in the main circuit is larger than or equal to a threshold so that the current in the main circuit is reduced to be less than the threshold.

The current control system provided by the present invention reduces the current in the main circuit by reducing the brightness level of the backlight unit, and the control mode thereof is simple. Therefore, it is able to reduce the processing time by more than 10 ms compared with the prior art, and the fast and effective response is an important factor for extending the life of the battery. In addition, the current control system provided by the present invention has other advantages, e.g., low number of components, simple structure, etc.

The embodiments mentioned in this summary of the invention will be further described in more detail in the detailed description. The summary of the invention neither implies that it is intended to limit the essential features and necessary technical features of the technical solution to be protected, nor implies that it is intended to define the protection scope of the technical solution to be protected.

Advantages and features of the present invention will be described in detail below in connection with the accompanying drawings.

BRIEF DESCRIPTION OF THE DRAWINGS

In order that the advantages of the invention will be readily understood, a more detailed description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings. In the drawings, FIG. 1 is a schematic block diagram of the current control system used in a flat panel electronic device according to one embodiment of the present invention.

DETAILED DESCRIPTION

In the following discussion, details are presented so as to provide a more thorough understanding of the present invention. However, the present invention may be implemented without one or more of these details as would be apparent to one of ordinary skill in the art. Certain examples are illustrated without elaborate discussion of technical features that would be within the purview of one of ordinary skill in the art so as to avoid confusion with the present invention.

According to one aspect of the present invention, a current control system of a flat panel electronic device (hereinafter referred to as current control system) is provided. FIG. 1 is a schematic block diagram of the current control system applied to the flat panel electronic device. As shown in FIG. 1, the current control system comprises a detecting means 110 and a control means 120.

The detecting means 110 is used to detect a current in a main circuit of the flat panel electronic device. The detecting means 110 may detect the current in the main circuit 111 directly. As an example, the detecting means 110 may be connected to the main circuit 111 in series, as shown in FIG. 1, so as to detect the current in the main circuit. The detecting means 110 may also obtain the current in the main circuit by detecting ½, ⅓rd, ¼th, ⅕th, ⅙th, ⅐th, ⅛th, ⅑th or ⅒th of the current in the main circuit, etc. Alternatively, in one embodiment, by way of example, the detecting means 110 may be connected to the main circuit 111 of the flat panel electronic device in parallel, as shown in FIG. 1, and obtain the current in the main circuit by detecting a branch current. In a different embodiment, detecting means 110 may also obtain the current in the main circuit by detecting the current of another electronic element, which may be in proportion to the current in the main circuit. The detecting means 110 may detect the current in the main circuit of the flat panel electronic device in real time, or detect the current in the main circuit at a predetermined time interval. The predetermined time interval may be set to factory default levels or be set by the user according to an actual situation.

The control means 120 reduces a brightness level of a backlight unit 130 of the flat panel electronic device when the current in the main circuit is larger than or equal to a threshold so that the current in the main circuit is reduced to be less than the threshold. The control means 120 may be integrated into a main control unit of the flat panel electronic device, or be configured independently. The control means 120 may reduce the brightness level of the backlight unit 130 by reducing the current of the backlight unit 130. The control means 120 may also regulate the brightness level of the backlight unit 130 by regulating the duty ratio of the current. Preferably, the control means 120 reduces the brightness level of the backlight unit 130 by reducing the current of the backlight unit 130 so that the current in the main circuit is reduced to be less than the threshold quickly and effectively. The threshold may be set to be equal to the maximum allowable discharge current of the battery, or less than the maximum allowable discharge current of the battery. Those skilled in the art would know to set the threshold according to the performance of the battery and the lowest brightness level of the backlight unit suitable for the users.

Preferably, the detecting means 110 may be a current sensing resistor 112. The current sensing resistor is connected to the circuit to be detected in series, and the current sensing resistor achieves the detection by converting the current into a voltage signal. The resistance value of the current sensing resistor is low, and therefore, it may avoid increasing the power consumption of the flat panel electronic device, and also avoid too much heat from being produced and accumulating in the flat panel electronic device. Furthermore, the precision of the current sensing resistor is relatively high, and the precision is generally less than ±1% or even less than ±0.01% at the higher requirement. Therefore, the current sensing resistor may detect the current in the main circuit accurately and precisely so as to avoid a situation where the instantaneous current in the main circuit exceeds the maximum allowable discharge current, but it is not detected by the detecting means 110.

the instantaneous current in the main circuit exceeds the maximum allowable discharge current, but it is not detected by the detecting means 110.

According to one embodiment of the present invention, the control means 120 may comprises a comparator 121 and a backlight regulator 122. The comparator 121 compares a detection signal of the current in the main circuit with a threshold signal. The threshold signal may be a signal representing the threshold when the detecting means 110 detects the current in the main circuit directly and sends it to the comparator 121. The threshold signal may be a signal representing the corresponding ratio of the threshold when the detecting means 110 detects the branch current and sends it to the comparator 121. For example, the threshold signal may be a signal representing $1/10^{th}$ of the threshold when the branch current detected by the detecting means 110 is $1/10^{th}$ of the current in the main circuit. After comparing the detection signal with the threshold signal, the comparator 121 may send the compared results to the backlight regulator 122. The backlight regulator 122 regulates the brightness value of the backlight unit 130 according to the compared result. The backlight regulator 122 reduces the brightness level of the backlight unit 130 when the compared result indicates that the current in the main circuit is larger than the threshold.

Preferably, the control means 120 further comprises an amplifying circuit 123. In this case, the detection signal sent to the comparator 121 is the signal amplified by the amplifying circuit 123. The amplifying circuit 123 amplifies the signal received from the detecting means 110 and sends it to the comparator 121, and thus it is convenient for the comparator 121 to compare. For example, when the detecting device 110 detects the branch current which may be $1/10^{th}$ of the current in the main circuit or smaller, it may detect the deviation easily if the branch current is directly compared with ⅒ of the threshold. To be noted, if the current detected by the detecting means 110 is amplified by the amplifying circuit 123, the threshold signal to be compared in the comparator 121 also needs to be adjusted correspondingly.

Preferably, the threshold comprises a first threshold 113 and a second threshold 114, wherein the first threshold is smaller than the second threshold. For example, the first threshold may be ¾th of the second threshold. The control means 120 controls the backlight unit 130 to reduce to a first brightness level which is relatively brighter than a second brightness level, when the current in the main circuit is larger than or equal to the first threshold and less than the second threshold. And, the control means 120 controls the backlight unit 130 to reduce to a second brightness level which is relatively darker than a first brightness level, when the current in the main circuit is larger than or equal to the second threshold. The control means 120 may estimate which one of the three following cases the current in the main circuit detected by the detecting means 110 belongs to: smaller than the first threshold, in the range of the first threshold to the second threshold, or larger than the second threshold. The control means 120 would not operate and the brightness level of the back light unit 130 would still be the standard brightness level when the current in the main circuit is estimated to be smaller than the first threshold, the brightness level of the back light unit 130 would be regulated to the first brightness level when the current in the main circuit is estimated to be in the range of the first threshold to the second threshold, and the brightness level of the back light unit 130 would be regulated to the second brightness level when the current in the main circuit is estimated to be larger than the second threshold.

Preferably, the control means 120 regulates the brightness level of the backlight unit 130 to the standard brightness level when the current in the main circuit detected by the detecting means 110 is less than the threshold for a predetermined time interval. The peak current of the flat panel electronic device is generally in instantaneous state. The control means 120 ensures that the peak current does not exceed past the threshold level temporarily during the predetermined time interval. The brightness level of the backlight unit 130 is regulated to the standard brightness level to restore the normal use of the flat panel electronic device when the control means 120 estimates that the current in the main circuit is less than the threshold during the predetermined time interval. Preferably, the predetermined time interval may be 5~10 s. The time interval of 5~10 s is a suitable time period for estimating whether the flat panel electronic device is running steadily or not.

As mentioned above, the detecting means 110 may be connected to the main circuit of the flat panel electronic device in series to detect the current in the main circuit directly, and the detecting means 110 may also be connected to the main circuit of the flat panel electronic device in parallel, so as to detect the branch current and then obtain the current in the main circuit. Preferably, the detecting means 110 is connected to the main circuit of the flat panel electronic device in parallel, and consequently the power consumption and the heat produced by the detecting means 110 can be reduced.

A flat panel electronic device is further provided according to another aspect of the present invention. The flat panel electronic device has any current control system as mentioned above. Each component contained in the current control system as well as their connecting relation may refer to the description of the respective part above. Therefore, it is no longer described in detail in the present invention for the sake of simplicity.

The current control system provided by the present invention reduces the current in the main circuit by reducing the brightness level of the backlight unit, and the control mode thereof is simple. Therefore, it is able to reduce the processing time by more than 10 ms compared with the prior art, and the fast and effective response is an important factor for extending the life of the battery. In addition, the current control system provided by the present invention has advantages of low number components, simple structure and so on.

The present invention has been described by the above-mentioned embodiments. However, it will be understand that the above-mentioned embodiments are for the purpose of demonstration and description and not for the purpose of limiting the present to the scope of the described embodiments. Moreover, those skilled in the art could appreciate that the present invention is not limited to the above mentioned embodiments and that various modifications and adaptations in accordance of the teaching of the present invention may be made within the scope and spirit of the present invention. The protection scope of the present invention is further defined by the following claims and equivalent scope thereof.

What is claimed is:

1. A current control system of a flat panel electronic device, the current control system comprising:

a detecting module operable to detect a current in a main circuit of the flat panel electronic device; and a control mechanism operable to reduce a brightness level of a backlight unit of the flat panel electronic device when the current in the main circuit is larger than or equal to a threshold, wherein the current in the main circuit is reduced to be less than the threshold, wherein the threshold comprises a first threshold signal and a second threshold signal, wherein the first threshold signal is smaller than the second threshold signal, wherein the control mechanism is operable to control the backlight unit to reduce to a first brightness level when the current in the main circuit is larger than or equal to the first threshold signal.

2. The current control system according to claim 1, wherein the control mechanism further comprises:

a comparator operable to compare a detection signal of the current in the main circuit with a threshold signal; and a backlight regulator for operable to regulate the brightness level of the backlight unit according to a comparison result.

3. The current control system according to claim 1, wherein the control mechanism further comprises an amplifying circuit operable to amplify the detection signal.

4. The current control system according to claim 1, wherein the control mechanism is further operable to control the backlight unit to reduce to a second brightness level when the current in the main circuit is larger than or equal to the second threshold signal, wherein the second brightness level is lower than the first brightness level.

5. The current control system according to claim 1, wherein the control mechanism is operable to regulate the brightness level of the backlight unit to a standard brightness level when the current in the main circuit detected by the detecting module is less than a threshold signal in a predetermined time interval.

6. The current control system according to claim 5, wherein the predetermined time interval is 5~10 seconds.

7. The current control system according to claim 1, wherein the detecting module is coupled to the main circuit of the flat panel electronic device in parallel, and the detecting module obtains the current in the main circuit by detecting a branch current.

8. The current control system according to claim 1, wherein the detecting module comprises a current sensing resistor.

9. The current control system according to claim 1, wherein the control mechanism is operable to reduce the brightness level of the backlight unit by reducing the current of the backlight unit.

10. A flat panel electronic device, having a current control system, the current control system comprising:

a detecting module operable to detect a current in a main circuit of the flat panel electronic device; and a control device operable to reduce a brightness level of a backlight unit of the flat panel electronic device when the current in the main circuit is larger than or equal to a threshold so that the current in the main circuit is reduced to be less than the threshold, wherein the threshold comprises a first threshold signal and a second threshold signal, wherein the first threshold signal is smaller than the second threshold signal, wherein the control device is operable to control the backlight unit to reduce to a first brightness level when the current in the main circuit is larger than or equal to the first threshold signal.

11. The flat panel electronic device according to claim 10, wherein the control device comprises:

a comparator operable to compare a detection signal of the current in the main circuit with a threshold signal; and a backlight regulator operable to regulate the brightness level of the backlight unit according to a comparison result.

12. The flat panel electronic device according to claim 11, wherein the control device further comprises an amplifying circuit operable to amplify the detection signal.

13. The flat panel electronic device according to claim 10, wherein the control device is further operable to control the backlight unit to reduce to a second brightness level when the current in the main circuit is larger than or equal to the second threshold signal, wherein the second brightness level is lower than the first brightness level.

14. The flat panel electronic device according to claim 10, wherein the control device is operable to regulate the brightness level of the backlight unit to a standard brightness level when the current in the main circuit detected by the detecting module is less than a threshold signal in a predetermined time interval.

15. The flat panel electronic device according to claim 14, wherein the predetermined time interval is 5~10 seconds.

16. The flat panel electronic device according to claim 10, wherein the detecting module is coupled to the main circuit of the flat panel electronic device in parallel, and the detecting module obtains the current in the main circuit by detecting a branch current.

17. The flat panel electronic device according to claim 10, wherein the detecting module is a current sensing resistor.

18. The flat panel electronic device according to claim 10, wherein the control device is operable to reduce the brightness level of the backlight unit by reducing the current of the backlight unit.

19. A method of controlling a current in a flat panel electronic device, said method comprising:

detecting a current in a main circuit of the flat panel electronic device; and reducing a brightness level of a backlight unit of the flat panel electronic device when the current in the main circuit is larger than or equal to a threshold so that the current in the main circuit is reduced to be less than the threshold, wherein the threshold comprises a first threshold signal and a second threshold signal, wherein the first threshold signal is smaller than the second threshold signal, wherein a control mechanism is operable to control the backlight unit to reduce to a first brightness level when the current in the main circuit is larger than or equal to the first threshold signal.

20. The method of claim 19, wherein said reducing further comprises:

comparing a detection signal of the current in the main circuit with a threshold signal; and regulating the brightness level of the backlight unit according to a comparison result.

* * * * *